US005348038A

United States Patent [19]

Krimm

[11] Patent Number: 5,348,038

[45] Date of Patent: Sep. 20, 1994

[54] FOAM INLET DEVICE FOR LIQUID TANKS

[75] Inventor: Alexander Krimm, Oberhausen, Fed. Rep. of Germany

[73] Assignee: Hoechst Aktiengesellschaft, Fed. Rep. of Germany

[21] Appl. No.: 992,854

[22] Filed: Dec. 16, 1992

[30] Foreign Application Priority Data

Dec. 21, 1991 [DE] Fed. Rep. of Germany ..... 4142562

[51] Int. Cl.[5] ..... A62C 3/06

[52] U.S. Cl. ..... 137/68.1; 222/80

[58] Field of Search ..... 137/68.1, 69, 70, 71; 222/80, 347

[56] References Cited

U.S. PATENT DOCUMENTS

| | | | |
|---|---|---|---|
| 2,706,527 | 4/1955 | Guljas et al. | 169/4 |
| 2,922,544 | 1/1960 | Hibbard | 137/68.1 |
| 3,552,495 | 1/1971 | Fiero | 169/28 |
| 3,834,580 | 9/1974 | Ludwig | 137/68.1 |
| 3,922,767 | 12/1975 | Solter | 137/68.1 |
| 4,301,938 | 11/1981 | Wood | 137/68.1 |
| 4,463,865 | 8/1984 | Mundt | 137/68.1 |

FOREIGN PATENT DOCUMENTS

| | | |
|---|---|---|
| 490400 | 7/1949 | Belgium . |
| 2552336 | 6/1985 | France . |
| 8089 | 7/1910 | United Kingdom . |

*Primary Examiner*—John C. Fox
*Attorney, Agent, or Firm*—Jordan B. Bierman

[57] ABSTRACT

An inlet device especially for introduction of foam into liquid-containing tanks. It comprises a two-part frame with a preferably circular opening. Each of the mutually opposed frame parts are provided with a groove around the circumference of the opening, which receives annular cutters and, if appropriate, adapter rings or blocks.

12 Claims, 5 Drawing Sheets

FOAM INLET DEVICE FOR LIQUID TANKS

This application claims the benefit of the priority of German Application P 41 42 562.6, filed Dec. 21, 1991.

BACKGROUND OF THE INVENTION

For protection against fires, liquid tanks, particularly those containing flammable liquids, must be equipped with permanently installed fire protection systems. These systems substantially comprise pumps, reservoirs for foaming agents, admixing means, foam generators, means of initiation, and pipeline and distribution systems (cf. DIN 14 493, part 2).

There are foam discharging devices on the tanks which, in the event of a fire, introduce the foam into the interior of the tank. In order to prevent combustible vapors or liquids from the tank space from penetrating the pipeline system and flowing via the air intake opening of the foam generator out into the open atmosphere, the foam discharging devices are provided with so-called foam pots. These take the form of cylindrical vessels into which the foam line is introduced from the bottom; a knee pipe provided with a safety shut-off establishes the connection to the tank. The task of the foam pots is to close off the tank space from the foam line in the normal situation, but to clear access for the extinguishing agent when foaming of the interior of the tank is required. The safety shut-off of the foam pot must be corrosion-resistant with respect to the products which are stored in the tank and, when required, it must be possible for it to be easily destroyed or easily opened. Therefore, it is customary, as a safety shut-off, to use rupture disks of glass, i.e. a material which resists most chemicals stored in tanks but easily breaks.

Temperature differences which exist between the interior of the tank and the foam pot can result in condensation of liquid vapors in the knee pipe of the foam pot. If the condensates are corrosive, there is a risk that the knee pipe will be destroyed and the product stored in the tank will escape from the air intake opening of the foam pipes.

Even if the rupture disk is inset above the knee pipe using sealing cement with the aid of a ring construction, there is need for maintenance and repair work. Since the sealing cement is often not resistant to the products stored in the tank, the liquid vapor in the foam pot condenses and the stored product escapes. Moreover, the rupture disks of glass are fragile and can break in cases of temperature fluctuations owing to the different expansion coefficients of glass and metal.

Various attempts have already been made to eliminate the deficiencies indicated of the known devices. For instance, the foam pots have been produced from high grade steel instead of from normal grade galvanized steel. However, commercial considerations stand in the way of their widespread installation. The installation of knee pipes of high grade steel instead of normal grade steel in foam pots of customary steel has also not become established practice. In this respect, although the corrosion problems can be overcome by completely or partially changing the material, the difficulties in sealing off the tank space from the foam line are not overcome thereby. To achieve an increased seal tightness, therefore, both a holding means and a fastening ring for the rupture disk at the upper end of the knee pipe have been provided with an additional groove for receiving a seal of soft material. However, this design measure also did not result in the desired gas-tight seal.

SUMMARY OF THE INVENTION

It is, therefore, the object of the invention to provide a foam inlet device for liquid tanks which meets technical and commercial requirements, ensures a tight seal between the tank inner space and the foam line, and clears access for the extinguishing agent (foam) in the event of pressures such as those which can usually be caused by stationary foam extinguishing systems. Furthermore, the device is to be as maintenance-free as possible and be subject to few or no restrictions in the versatility of its applications.

This object is achieved by a foam inlet device for liquid tanks comprising a two-part frame with a preferably circular opening, the mutually opposite frame part with circular opening, the mutually opposite frame parts of which are located around the circumference of the opening with a sheet clamped therebetween. There is a groove for receiving annular cutters and, if appropriate, adapter rings to adjust the distance between the cutters and the sheet. The foam inlet device according to the invention (also referred to herein as an adapter) operates on the principle of the rupture disk, but further develops the basic ideas of the latter for the specific intended application.

The basis of the novel device is a two-part frame with a preferably circular opening. It is installed between the foam line and the foam inlet, i.e. the place at which the extinguishing foam enters the tank. To facilitate the exchanging of the adapters, each frame part is provided with a flange. It goes without saying that this method of installation does not have to be used; instead, the device can be fitted into the pipeline and distribution system in other ways, depending on local conditions and technical requirements. The size and shape of the frame can be chosen as desired. On the other hand, the diameter of the circular opening in the frame (i.e. the two frame parts) coincides with the inside diameter of the foam line and the foam introduction connection. Clamped between the frame parts is a sheet which separates the tank and foam line from each other and prevents vapors of the stored product from passing into the open atmosphere.

A significant feature of the adapter is the groove inset in each of the two frame parts. The groove extends around the entire circumference of the opening, receives the cutters and, if appropriate, an adapter ring or, if it is desired to completely fill the groove, an adapter block.

The edges of the annular (ring) cutters face the sheet and are designed to cut out the sheet, when required, around the entire periphery of the frame opening, thereby clearing the line so that the foam can be fed into the interior of the tank. Several measures, alone or in combination, are employed for setting the rupture pressure, i.e. that pressure developed by the foam extinguishing system at which the sheet is cut from the adapter. In this context, it must be remembered that the overpressure does not reach high values; it rarely exceeds 80 kPa (0.8 bar) and is generally somewhere in the range from 40 to 70 kPa (0.4 to 0.7 bar).

DETAILED DESCRIPTION OF THE INVENTION

The rupture behavior of the sheet depends, at least partly, on its thickness and the material of which it is made. It is, of course, required that the material be resistant to the product stored in the tank and that its properties change only insignificantly or not at all under the conditions (e.g. changing temperature) of its operation. Suitable materials are thermoplastics such as polyethylenes, polypropylenes, polyacetals, polyesters, and polytetrafluoroethylenes. Polytetrafluoroethylenes, which can be used almost universally due to their resistance to chemicals, have proven particularly successful. With a given rupture pressure, the sheet thickness is dependent on the material and the other measures which are provided to effect the tearing open of the sheet.

It is a feature of the invention that the adapter can be set to a predetermined rupture pressure which is characteristic of the specific foam extinguishing system. The distance of the cutters from the plane of the sheet is fixed in a simple way by inserting adapter rings into the groove of the frame parts.

By fitting a cutter into the groove which faces the tank, the adapter can open to introduce foam into the tank. An embodiment of the adapter according to the invention wherein both frame parts are provided with cutters of which the edges are facing the plane of the sheet allows not only the feeding of extinguishing foam into the tank, but also acts as a safety valve if overpressure occurs in the tank.

If only one frame half is equipped with a ring cutter, the groove of the opposite side is terminated substantially flush with the sealing face of the frame by adapter rings or an adapter block. If the ring cutter and/or adapter block are firmly connected to the respective frame halves, they should be provided with a bore to produce a pressure increase within the groove; this facilitates the shearing off of the sheet. It has proved successful to provide the ring cutters or—in the case of a ring cutter/adapter ring combination—the ring cutter and adapter ring with a bore to ensure a pressure increase in the groove as well and to facilitate the shearing off of the sheet.

According to a preferred embodiment of the inventive adapter, the sheet clamped between the frame halves has a predetermined breaking point at the circumference of the ring cutter or cutters. This ensures that, on contact of the disk with the cutter or cutters, the cutting operation is performed instantaneously and is not delayed. Absent this expedient, it is possible that the cutting operation fails to take place, due to the material of the sheet merely bulging and creeping over the cutter edge. While a predetermined breaking point may be impressed in the sheet during production, it is preferably produced with the cutter or cutters after installation of the foam inlet adapter. The depth of the incision in the sheet is dependent, not only on the rupture pressure, but also on the sheet material and thickness, and must be determined empirically.

The plane of the edges of the ring cutters usually runs parallel to the plane of the sheet, i.e. the cutters meet the sheet at an angle of 90°. In special cases, it may be expedient to incline the cutter edges with respect to the plane of the sheet, i.e. to set the angle between cutter edge and plane to values which are greater or less than 90°.

The sheet is clamped between the two frame halves. Fixing is performed in known ways, for example with the aid of a number of screw bolts which are arranged peripherally at intervals along the frame. The foam inlet device according to the invention can be produced by conventional processes from the metals or metal alloys known to be suitable for the intended uses.

As a departure from the practice usual in the installation of foam pots, it has proved successful to fit the novel foam inlet device into the foam line above the level of the top of the tank. For this purpose, the ascending foam line fitted on the tank can be extended beyond the level of the tank top and, by a deflecting bend, returned vertically downward to the cylindrical part of the tank and fastened thereto. The novel adapter is installed in the vertically descending part of the pipeline above the level of the top of the tank.

BRIEF DESCRIPTION OF THE DRAWINGS

Various embodiments of the foam inlet device according to the invention are explained in more detail below with reference to the attached drawings, wherein like reference characters indicate like parts.

FIG. 20 is a plan view of a foam inlet device according to the invention;

Figure 1:
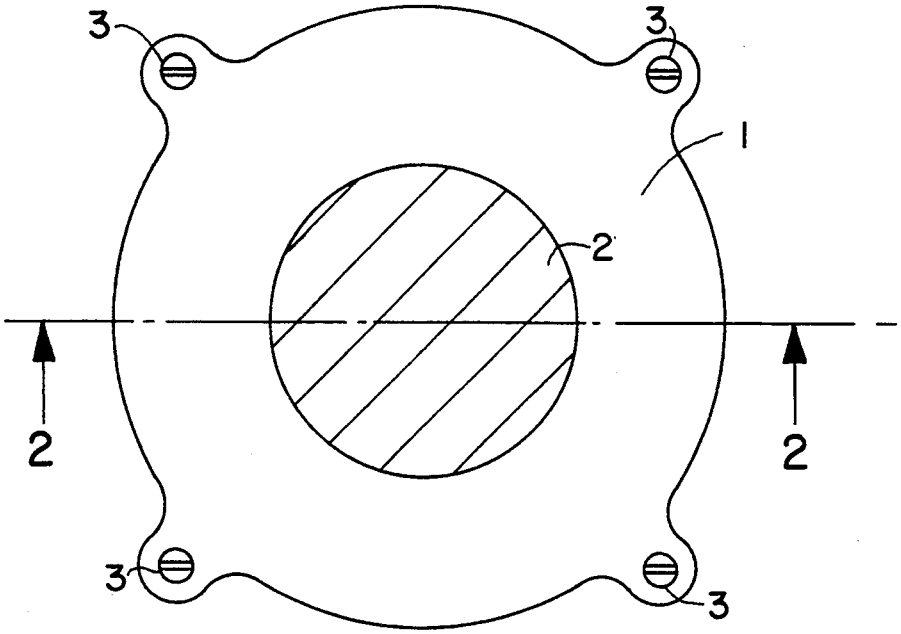
FIG. 1 is a plan view of a foam inlet device according to the invention.

Referring specifically to FIG. 1, the foam inlet device according to the invention comprises two-part frame 1, having circular opening 16 in which sheet 2 is clamped. Screw bolts 3, which are arranged circumferentially on frame 1, secure the parts of the device together.

Figure 2:
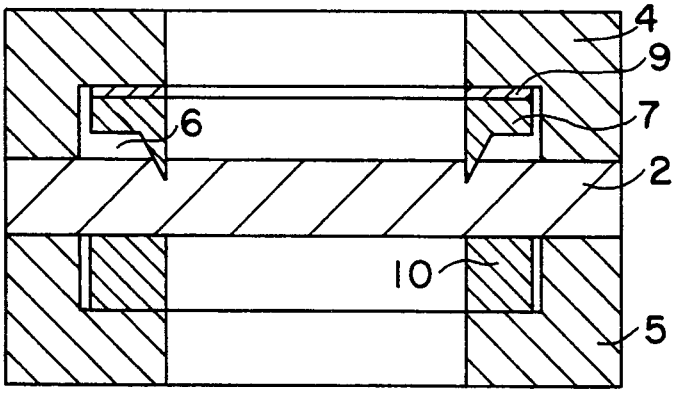
FIG. 2 is a cross section along line A-B of FIG. 1, showing a foam inlet device having a cutter loosely inserted in one frame part and a loosely inserted block in the other frame part.
Figure 3:
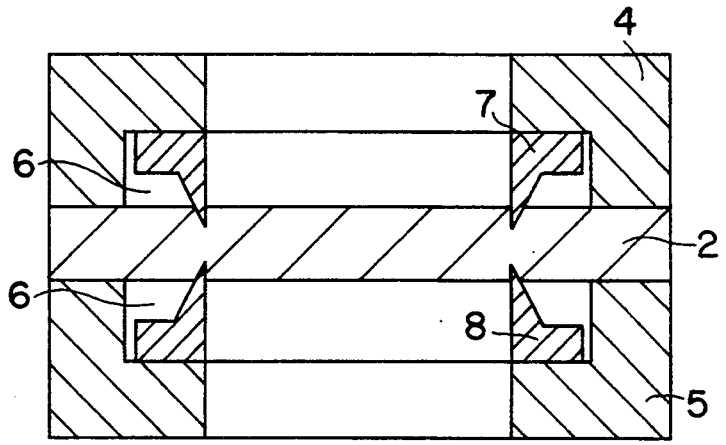
FIG. 3 is a cross section along line A-B of FIG. 1, showing a foam inlet device with cutters inset on both sides.

In FIG. 2, frame 1 comprises two frame parts 4 and 5, which are provided with grooves 6. One groove receives ring cutter 7 which is combined with adapter ring 9. Since only one frame part is equipped with ring cutter 7, the groove of the opposite side is terminated flush with the sealing face by adapter block 10. FIG. 3 shows an embodiment of the novel foam inlet device in which both grooves 6 are equipped with ring cutters 7 and 8, respectively.

Figure 2B:
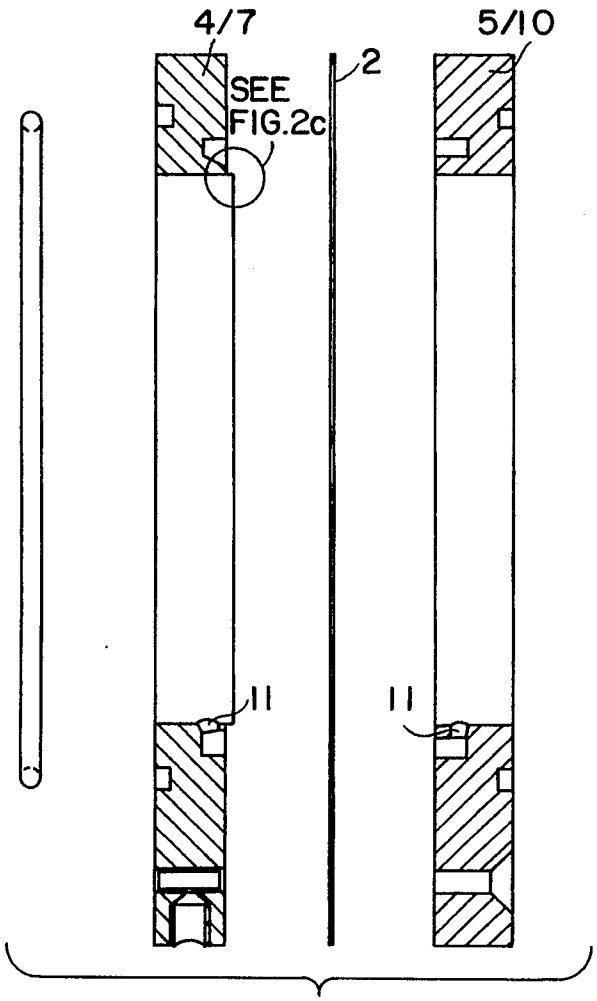
FIG. 2*b* illustrates a cross section of a foam inlet device with a ring cutter fixedly fixed in one frame part and an adaptor block fixedly fitted in the other frame part, both of which are provided with bores.
Figure 2C:
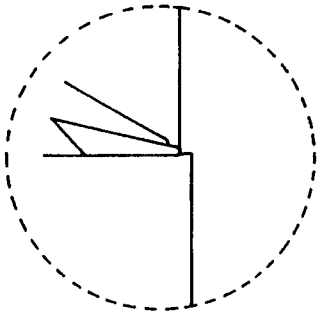
FIG. 2*a* shows an enlarged view of the indicated portion of FIG. 2*b;*
Figure 2A:
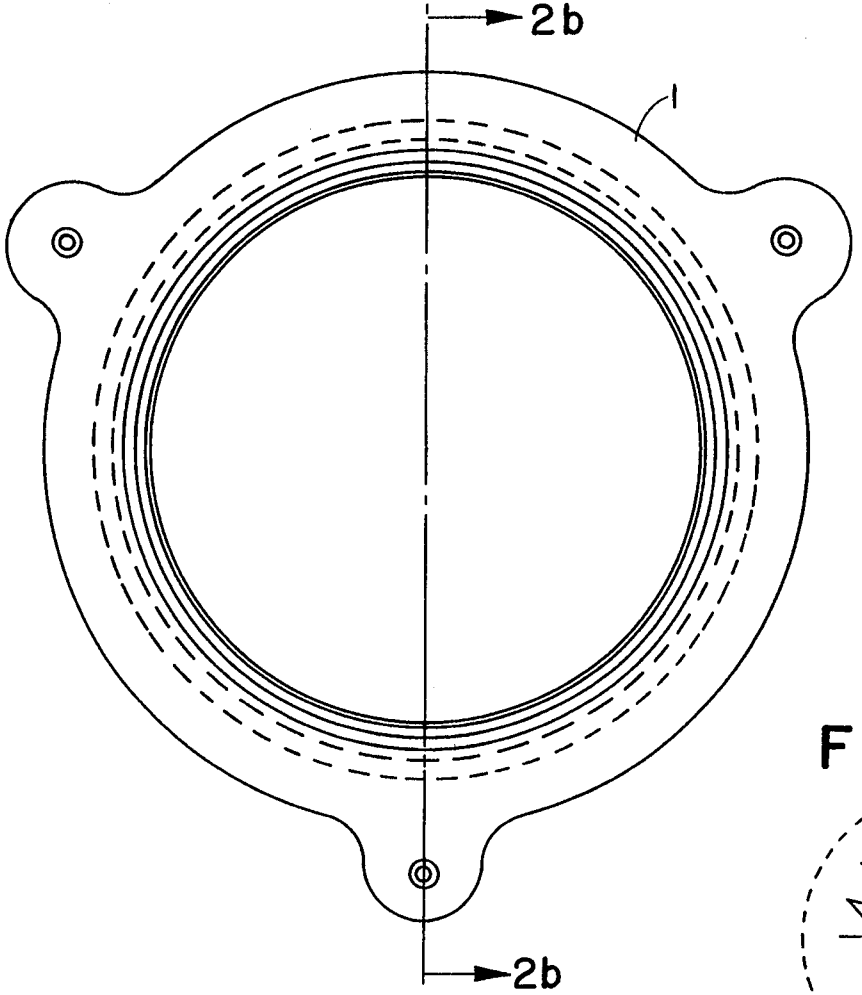
Figure 3B:
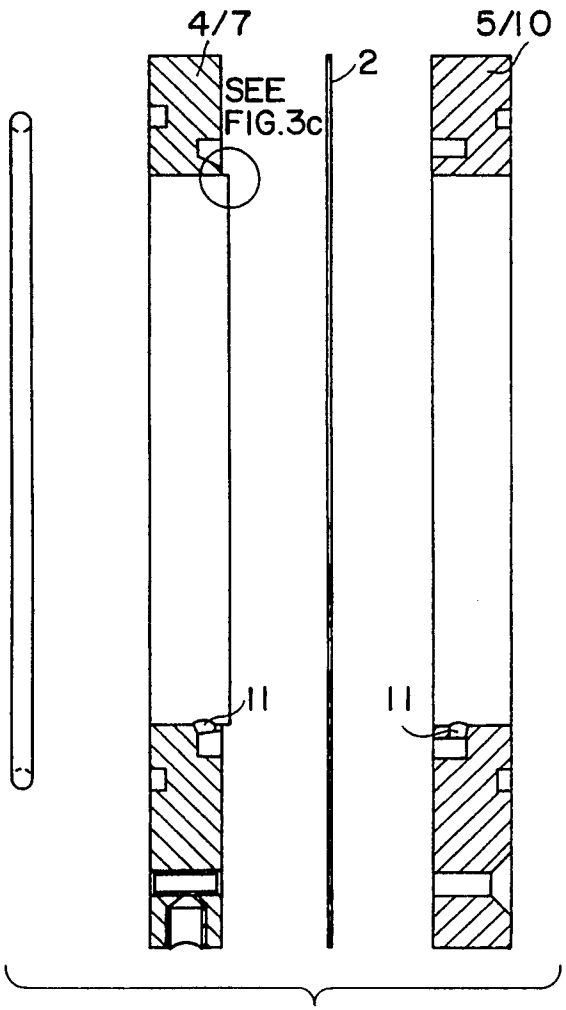
FIG. 3*b* is a cross section similar to that of FIG. 2*b*, showing a foam inlet device with ring cutters, which are provided with bores, fixedly fitted in both frame parts.
Figure 3C:
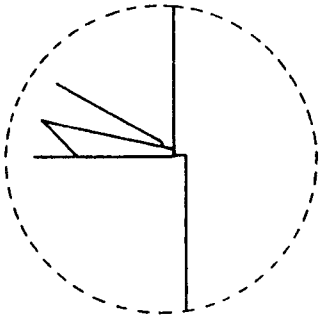
FIG. 3*c* shows an enlarged view of the indicated section of FIG. 3*b*, in a manner similar to FIG. 2*c*.
Figure 3A:
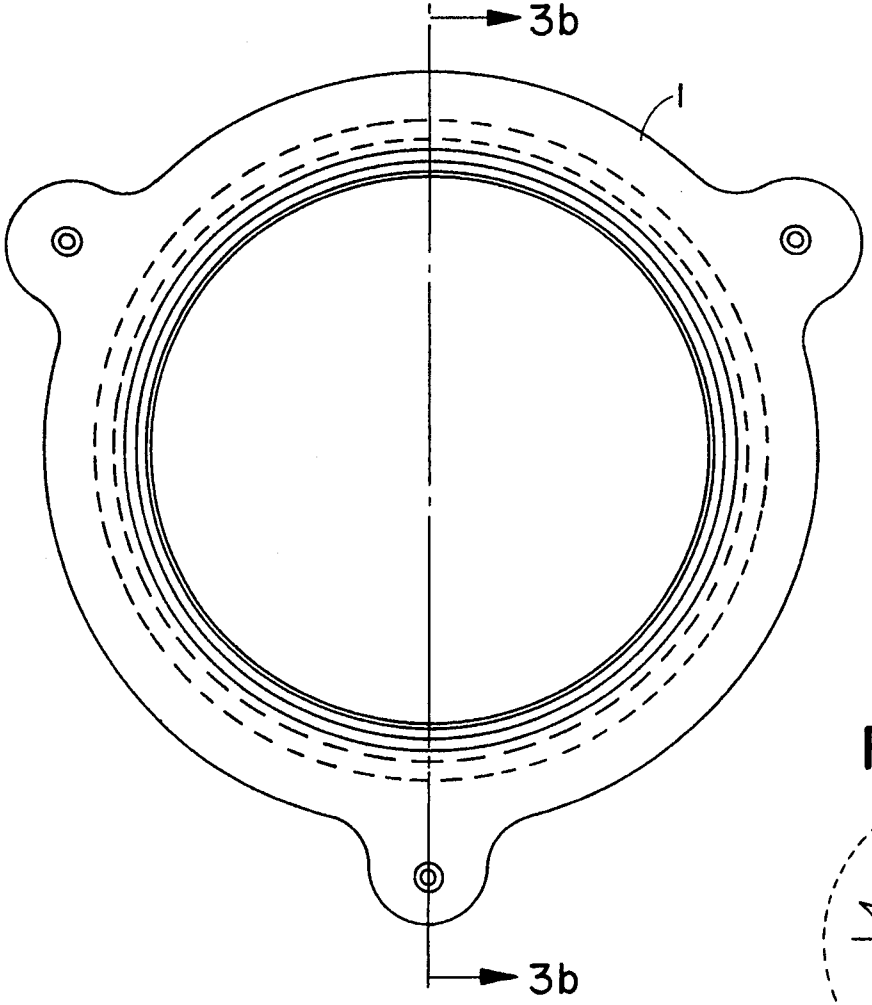
FIG. 3*a* is a cross section similar to that of FIG. 2*a*, showing a foam inlet device with ring cutters, which are provided with bores, fixedly fitted in both frame parts similar to FIG. 2*a;*

In FIG. 2*b*, the foam inlet device has ring cutter 7 fixedly fitted in frame part 4 and adapter block 10 fixedly fitted in frame part 5. Cutter 7 and block 10 are each provided with bore 11. FIG. 3*b* is similar to FIG. 2*b*. The foam inlet device is provided with cutters 7 and 8, fixedly fitted in frame part 4 and part 5, and which are each provided with bore 11.

In the normal state, sheet 2 is in the position shown in FIGS. 2 and 3. If, in the case of the embodiment of FIG. 2, the pressure changes to a value which corresponds to the predetermined response pressure, sheet 2 bulges in the direction of ring cutter 7 and is cut out around its entire circumference thereby. The embodiment represented in FIG. 3 acts, not only as a foam inlet device, but also as a safety valve if an overpressure occurs in the tank. Thus, sheet 2 is cut if the pressure changes to the predetermined value in either direction.

Figure 4:
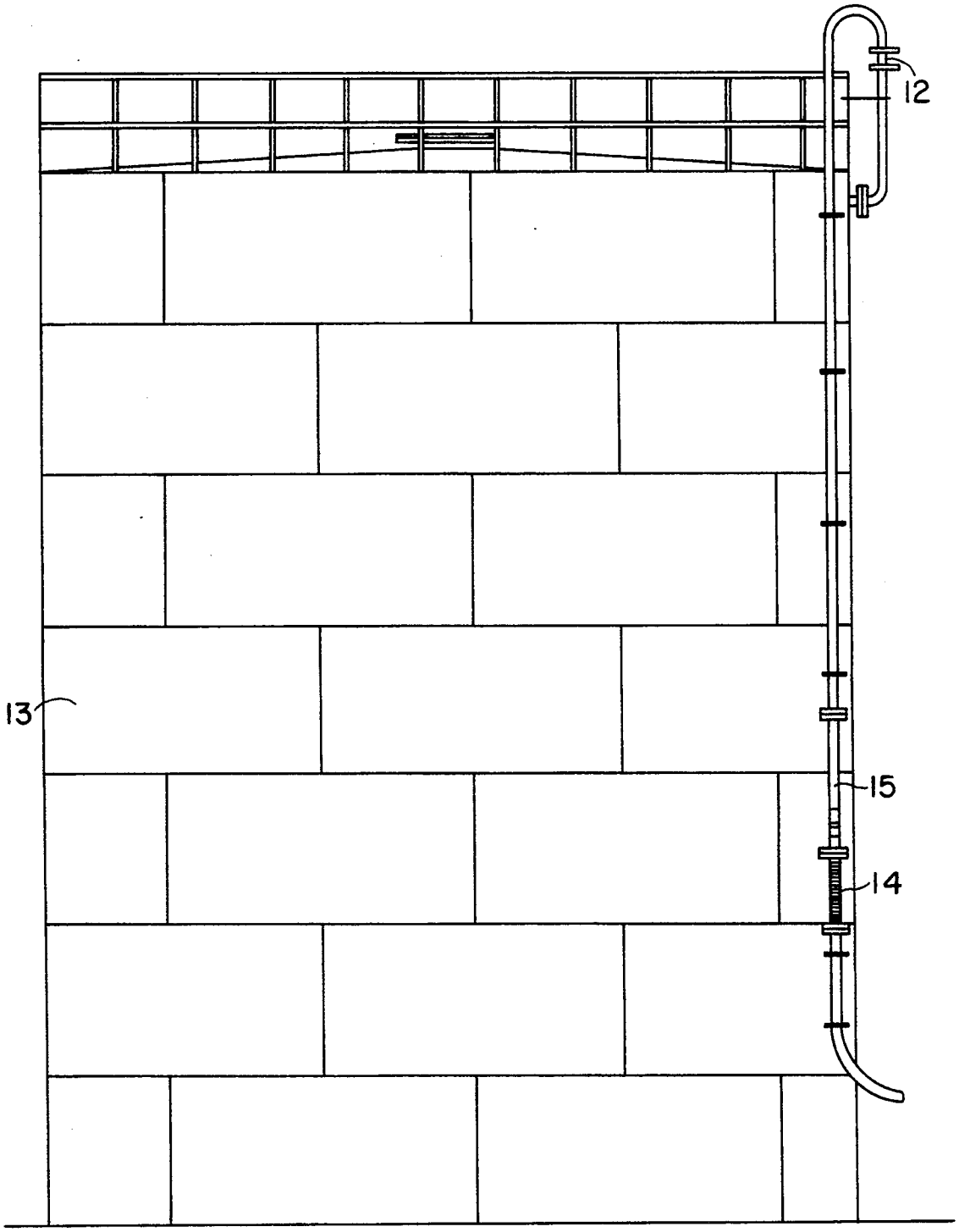
FIG. 4 is an elevation of a tank equipped with the novel foam inlet device.

In FIG. 4, foam line 15, provided with temperature compensator 14, ascends the side of tank 13 beyond the top thereof and, by a deflection bend, extends vertically downward to the cylindrical part of the tank. Foam inlet device 12 is fitted in the vertically descending portion of foam line 15.

Figure 5:
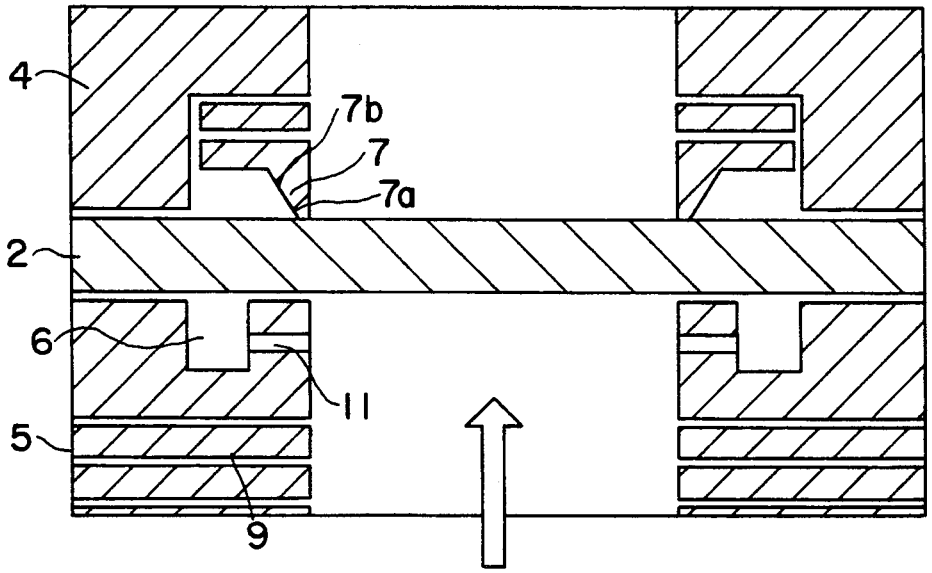
FIG. 5 is a view similar to that of FIG. 2 showing the bore.

Referring to FIG. 5, if there is an excess of pressure exerted from the bottom of the Figure toward the top in the direction of arrow P, there is a tendency for sheet 2 to bow upwardly and to slide over cutter 7. This is particularly true if sheet 2 is extremely thin. However, due to the presence of bore 11, this pressure is also communicated to groove 6. This, in turn, forces the periphery of sheet 2 upwardly, squarely against blade 7*a*. Thus, the cutting of sheet 2 is facilitated.

While only a limited number of specific embodiments of the present invention have been expressly disclosed, it is, nonetheless, to be broadly construed and not to be limited except by the character of the claims appended hereto.

I claim:

1. A device for controlling flow of fluid into or out of a tank comprising a frame having a first part and a second part, said first part and said second part having an opening therethrough and securing a sheet therebetween, a first peripheral groove in said first part, a second peripheral groove in said second part and facing said first groove, a first peripheral cutter having a cutting edge in said first groove, a first bore fluidly connecting said opening and said second groove, said cutting edge adapted to cut said sheet peripherally, thereby to permit said fluid to pass through said opening.

2. The device of claim 1 wherein said first peripheral groove being open toward said tank.

3. The device of claim 2 wherein there is an adapter block in said second peripheral groove, said block extending from a floor of said groove remote from said sheet to a location immediately adjacent said sheet.

4. The device of claim 3 wherein said first cutter and said adapted block are fixed to said first part and said second part respectively and each is provided with one said bore.

5. The device of claim 2 comprising a second peripheral cutter in said second groove, a second bore fluidly connecting said opening and said first groove, said cutter adapted to cut said sheet peripherally, thereby to permit fluid to leave said tank.

6. The device of claim 5 wherein said first cutter and said second cutter are fixed to said first part and said second part respectively, each of said first cutter and said second cutter being provided with one said bore.

7. The device of claim 1 wherein said opening and said first groove are circular and said cutter is correspondingly annular.

8. The device of claim 1 comprising at least one adapter ring in said first groove, said adapter ring located between a floor of said first groove, remote from said sheet, and said first cutter, whereby a plane defined by said cutting edge is located.

9. The device of claim 1 wherein said sheet is provided with a predetermined breaking point.

10. The device of claim 1 wherein said cutting edge defines a plane, said plane being substantially parallel to said sheet and said edge being substantially perpendicular thereto.

11. The device of claim 1 wherein said cutting edge defines a plane, said plane not being parallel to said sheet and said edge being non-perpendicular thereto.

12. A tank for containing a liquid having a bottom and a top, the device of claim 1 being located in a fluid carrying line above said top.

* * * * *